US006942297B2

(12) United States Patent
Johnson

(10) Patent No.: US 6,942,297 B2
(45) Date of Patent: Sep. 13, 2005

(54) PORTABLE LATERAL-SUPPORT HEADREST

(76) Inventor: Eric Eugene Johnson, 10740 Lawler St. Apt #1, Los Angeles, CA (US) 90034

( * ) Notice: Subject to any disclaimer, the term of this patent is extended or adjusted under 35 U.S.C. 154(b) by 0 days.

(21) Appl. No.: 09/932,424

(22) Filed: Aug. 17, 2001

(65) Prior Publication Data

US 2003/0038521 A1 Feb. 27, 2003

(51) Int. Cl.[7] ..... A47C 7/36
(52) U.S. Cl. ..... 297/397
(58) Field of Search ..... 24/68 R, 31 R, 24/32; 297/397, 391, 405, 404, 406, 408

(56) References Cited

U.S. PATENT DOCUMENTS

| | | | | |
|---|---|---|---|---|
| 486,374 | A | * | 11/1892 | Greenwood et al. |
| 529,364 | A | * | 11/1894 | Claudy et al. |
| 1,744,364 | A | | 1/1930 | Cruickshank |
| 2,638,152 | A | | 5/1953 | Pulsifeer |
| 3,608,964 | A | * | 9/1971 | Earl |
| 4,031,578 | A | | 6/1977 | Sweeney |
| 4,130,318 | A | | 12/1978 | Hemmen |
| 4,154,478 | A | * | 5/1979 | Cohune |
| 4,205,878 | A | | 6/1980 | Wooten |
| 4,440,443 | A | * | 4/1984 | Nordskog |
| 4,619,483 | A | | 10/1986 | Dickey |
| 4,971,393 | A | | 11/1990 | Maisenhalder |
| 5,015,036 | A | * | 5/1991 | Fergie |
| 5,108,150 | A | | 4/1992 | Stas |
| 5,129,705 | A | | 7/1992 | Wray |
| 5,220,700 | A | | 6/1993 | Liv |
| 5,544,378 | A | * | 8/1996 | Chow |
| 5,567,015 | A | | 10/1996 | Arias |
| 5,630,651 | A | | 5/1997 | Fishbane |
| 5,685,613 | A | * | 11/1997 | Franzen, Jr. |
| 5,868,471 | A | * | 2/1999 | Graham et al. |
| 5,975,638 | A | | 11/1999 | Schreiner |
| 6,033,023 | A | | 3/2000 | Strassner |
| 6,123,389 | A | * | 9/2000 | O'Connor et al. |

OTHER PUBLICATIONS

Unknown, "Air Travel Australia Economy," Nov. 19, 2001, www.australian.com/DIY/Air/DIYAirNZPacific.html,world wide web.

* cited by examiner

*Primary Examiner*—Milton Nelson, Jr.

(57) ABSTRACT

A portable headrest is disclosed providing extensive lateral support to persons sitting upright in chairs. The headrest is attached to the seat back of a chair, such as an airline seat or a geriatric chair, and is secured thereto with straps or in another suitable manner. A head-support portion extends well in front of the surface of the seat back and provides a rigid structure to support the side of user's head. Cushioning on top of this rigid structure ensures comfort. A base portion cooperates with the seat back and the head-support portion to maintain the position and alignment of the head-support portion. The headrest thus aids sleep for people who must stay in upright chairs for extended periods and alleviates muscle strain in infirmed persons while allowing them to sit upright.

9 Claims, 7 Drawing Sheets

PORTABLE LATERAL-SUPPORT HEADREST

CROSS-REFERENCES TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND OF THE INVENTION

This invention relates generally to headrests or cervical supports, specifically to head cushioning and supporting devices that attach to the upright portions of chairs, or seat backs.

The problems of resting or sleeping in an upright chair are well known to airline, rail, and bus travelers, and there are several attempted solutions in the prior art. Seats on common-carriers often recline only slightly. If a passenger falls asleep in such a position, he or she must unconsciously balance his or her head, constantly contracting many neck muscles. This eventually causes muscle strain and extreme discomfort for most travelers. A more immediate problem, however, is that by falling into a deeper state of relaxation, the head may suddenly fall to one side, waking the passenger and making the possibility of restful sleep remote or hopeless. Many travelers have tried to provide lateral support to their head by placing a pillow next to the hull of the vehicle or on the shoulder of a fellow passenger. The possible spatial orientations of this ad hoc solution are very limited, and the pillow is held fast only by the force of the user's head. A slight shift of the body, neck, or head will allow the pillow to fall out of place.

Patients in hospitals and nursing homes face the same problem when sitting in an upright chair. So that infirmed patients will not be confined to perpetual bed rest, specially designed geriatric chairs allow sitting upright. With wheels on the bottom, these chairs allow patients to move from room to room and participate in greater social interaction than would otherwise be possible. However, health-care professionals often struggle to find ways of providing lateral head-and-neck support for patients in these high-backed chairs. When sitting upright, as opposed to lying supine in bed, the force of the patient's head is no longer exclusively in the direction of the back of the head, but is also to the side. This is a particularly acute problem for sufferers from advanced forms of Parkinson's disease or certain survivors of stroke, whose muscle control is severely impaired. In an upright chair, such patients' heads will often lean abnormally to one side, muscles in the opposite side of the neck rigidly straining to keep the head from falling over. Pillows placed behind the head merely support the head from underneath, not to the side. As happens with sleepy travelers, the pillows used with a geriatric chair usually soon fall out of place.

Portable lateral head supports that are currently available for such geriatric settings contain the head on both sides. Rather than providing needed support and accommodating the abnormal leaning, these devices force patients' heads into a fully straight position, which is often uncomfortable. Patients and health-care professionals also dislike these head-surrounding devices because of their constricting and restraining nature, which is undesirable in attempting to provide a care setting that is as normal, comfortable, and humane as possible.

U.S. Pat. No. 1,744,364 issued to Cruickshank discloses a portable headrest releasably attaching to chairs. This device employs a U-shaped component for receiving a person's head. While providing considerable lateral support, this device encloses the head on both sides, restraining the user's head and restricting movement. Like many later laterally supporting headrests, Cruickshank's device pushes the head forward of the surface of the chair back. Thus, a sleepy traveler who is already restricted from reclining the seat as far as desirable, will have his or her head thrust even further forward, forcing an even less reclined, and therefore less restful orientation. The clamp like mechanism for attaching Cruickshank's headrest is awkward and the screw-in attachment-means can damage the chair.

U.S. Pat. No. 5,567,015 issued to Arias discloses an inflatable headrest apparatus that attaches to a seat with a strap extending around the sides of the chair back and a sheet going over the top of the seat back. This sheet restricts the vertical position of the headrest on the back of the chair, and thus Arias' apparatus cannot adjust for differing heights of chairs or users. Further, the inflatable modules against which the head is to rest do not extend far enough from the seat back and are too rounded to fully support a person's head and prevent it from rolling forward off the apparatus and then down to the chest or shoulder.

U.S. Pat. No. 5,630,651 issued to Fishbane discloses a portable pressure adjustable cervical pillow with elements on either side of the head to provide lateral support. One problem with Fishbane is that the primary element of this pillow is behind the user's head, not to the side of it. Like Cruickshank's device, this pushes the head forward relative to the body, which tends to defeat the ability of the user to fall asleep. Moreover, the laterally supporting elements are comprised of cylinders that extend outward from the seat only a short distance compared to the diameter of the user's head. Thus, as with Arias' apparatus, Fishbane's pillow provides very little lateral support—not enough for an upright user to rest the full weight of his head and neck on the support without the head rolling or drooping. Diagonal straps that travel across the top edge of the seat back restrict the pillow's position vertically on the seat back. Additionally, the position of the lateral supports cannot be horizontally adjusted either.

U.S. Pat. No. 5,975,638 issued to Schreiner discloses a pillow for sleeping upright in a chair that attaches with a sheet and straps in a manner similar to Arias's device. Schreiner's lateral support could not support a fully relaxed human head unless the chin strap is used, thereby greatly restricting movement of the head. Again, as with many other such headrests, an element behind the head thrusts the head forward.

U.S. Pat. No. 2,638,152 issued to Pulsifier discloses a one-sided headrest to be screw-clamped onto a seat back. The clamping mechanism is awkward both in use and storage. Further, the surface of the headrest is of such a size and shape that the user must predetermine exactly which position in which he or she will sleep. Any movement during sleep will cause the user to be beyond the headrest's supporting surface, or will cause the supporting surface to connect uncomfortably with a portion the ear or face.

Some devices with a larger surface for lateral support do not attach securely to a seat back, thus largely or completely defeating the purpose of allowing the user's head and neck fully to relax. See, for example, U.S. Pat. No. 4,013,578 issued to Sweeney, et al.

U.S. Pat. No. 4,205,878 issued to Wooten discloses a headrest with considerable lateral support, but the device must be built into a seat back.

U.S. Pat. No. 6,033,023 issued to Strassner discloses a portable, attachable headrest for travelers. This device, while providing considerable lateral support, may only be used in certain very limited situations, such as having an adjoining seat sufficiently close to allow the device to be wedged in between seats for secure placement.

BRIEF SUMMARY OF THE INVENTION

The present invention is a portable laterally supporting headrest for use with high-back chairs. The headrest includes a means for secure lashing to the seat back—preferably straps of nylon webbing with length-adjustable buckles of the type found at the base of shoulder straps on ordinary backpacks. The headrest preferably has an L-shaped structure, with one line of the "L" being a cushioned member extending away from the seat back to provide support for the side of the head and face. The other line of the "L" is a member that lies flat against the seat back, providing a rigid base to hold the cushioned member in an approximately perpendicular plane to the seat back.

Accordingly, several objects and advantages of my invention are to provide a portable cushioned headrest with vastly greater lateral support on only one side of the head so that the user may fully relax the neck and rest the entirety of the head without being restrained or restricted in movement. It is another object of the present invention that the headrest should be attachable to a seat back in a manner that is fully adjustable in terms of vertical and horizontal placement on the chair and that will not damage the chair or require a chair with a specialized engagement apparatus. A further object and advantage of my headrest is to provide a cushioned head-supporting surface that is at once comfortably yielding to a user's head, resilient and springy to provide gentle dissipated support, and backed by a rigid structure to allow full relaxation of opposing musculature.

Another object and advantage of my headrest is that should a person desire to have both sides of the head supported, two articles of this invention may be placed facing one another on the same chair back in whatever orientation suits a particular user's height and head width, and the two headrests will act in concert to form a bilateral supporting arrangement.

In particular, for a patient in a geriatric chair, it is an advantage of my invention that it only supports the head in the direction in which it is tending to lean, and therefore it supports head during abnormal posture without forcing it into a position to which the patient will be resistant.

Further objects and advantages of my invention will become apparent from a consideration of the drawings and ensuing description.

REFERENCE NUMERALS IN DRAWINGS

| | |
|---|---|
| 10 | headrest |
| 11 | user |
| 12 | seat back |
| 13 | strap |
| 13A | strap |
| 14 | head-support portion |
| 15 | base portion |
| 16 | length-adjustable buckle |
| 16A | length-adjustable buckle |
| 17 | excess strap length |
| 17A | excess strap length |
| 18 | cushion side |
| 20 | flat surface |
| 21 | convex cushioning portion |
| 22 | base board |
| 23 | fabric cover |
| 24 | staples |
| 25 | head-support board |
| 26 | screws |
| 27 | steel hardware L-brace |
| 28 | fastening screws |
| 29 | cushioning material |
| 30 | hinged joint |
| 31 | interlocking cylindrical elements |
| 32 | tube through the rotational axis |
| 33 | threaded bold |
| 34 | wingnut |
| 35 | pivot |
| 36 | inflatable structure |
| 37 | air inlet valve |
| 38 | strap loops |
| 39 | slide-back stoppers |

DETAILED DESCRIPTION OF THE INVENTION

The following description relates to the preferred embodiment and certain alternative embodiments of the invention and is for the purpose of describing the invention's general principles. The invention's scope is to be determined by the claims, and the ensuing description should not be construed in a limiting sense.

Description of Preferred Embodiment

Figure 1:
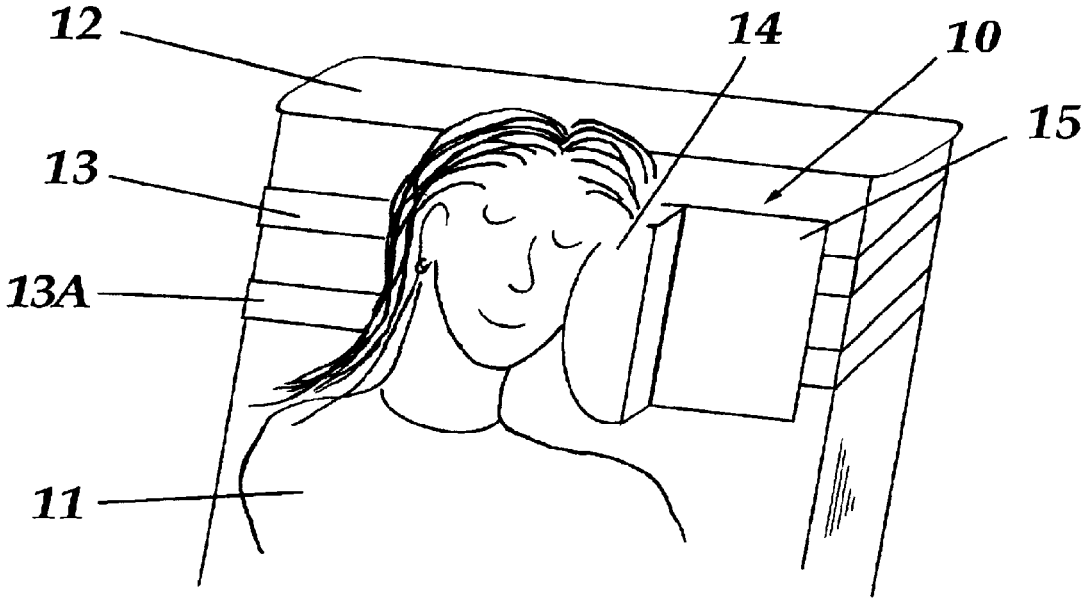
FIG. 1 is a perspective view of the preferred form of the headrest in use, attached to a seat back.

FIG. 1 shows a user 11 laying her head against a headrest 10. The headrest is secured to a seat back 12 by means of straps 13 and 13A. The straps completely encircle the seat back, holding the headrest securely against the surface of the seat back, and, lying flat, pass underneath the user's head so that there is no pushing forward of the head or discomfort to the user. Such straps are preferably made of nylon webbing of the kind used for straps on backpacks or gym bags. The headrest comprises two main portions, base portion 15 and head-support portion 14. The head-support portion extends away from the surface of the seat back, roughly in a plane that intersects with the surface of the seat back in a vertical and perpendicular manner. The head-facing side of the head-support portion is a convex cushioning portion which supports the weight of the user's head in a lateral direction. The base portion lies fast against with the seat-back surface opposite the side of the user's head.

Figure 1A:
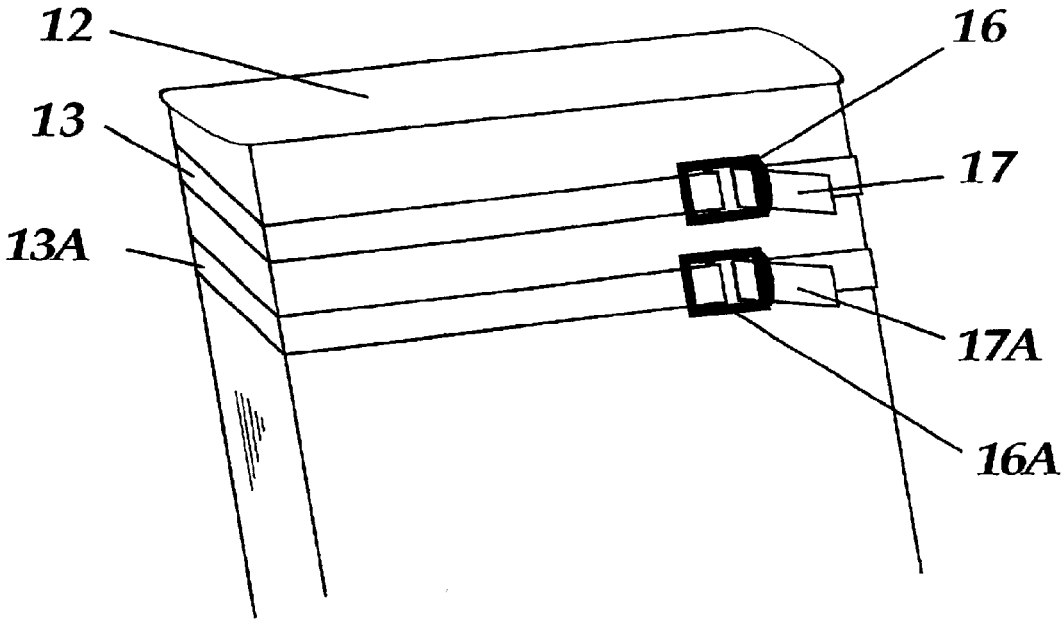
FIG. 1A is a perspective view of the back side of the chair to which said headrest is attached, showing the preferred attachment means.

FIG. 1A depicts the reverse side of the seat back 12 depicted in FIG. 1. Straps 13 and 13A are shown wrapping around the entirety of the seat back. The two ends or portions of each strap are bound together with length-adjustable buckles 16 and 16A, of the kind found at the base of the shoulder straps on an ordinary backpack. The buckles are preferably made of steel or strong plastic. Excess strap lengths 17 and 17A hang downward.

Figure 2:
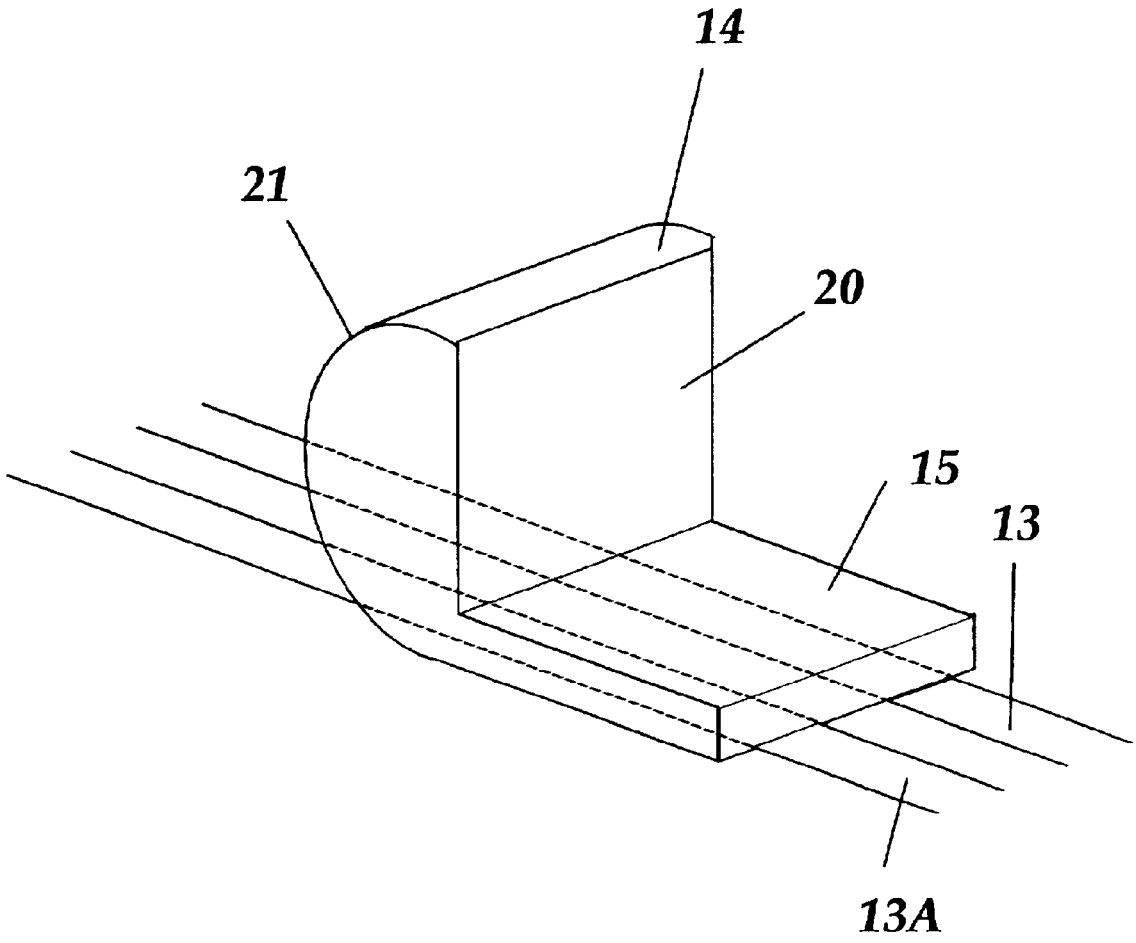
FIG. 2 is a perspective view of the preferred embodiment of the headrest apart from the seat back.

FIG. 2 shows the position of the straps 13 and 13A underneath the base portion 15 of the headrest 10. The head-support portion 14 extends outward from the plane of base portion 15 at a substantially right angle. The head-support portion 14 has a flat surface 20 facing the base portion and a convex cushioning portion 21 on the obverse side.

Figure 3:
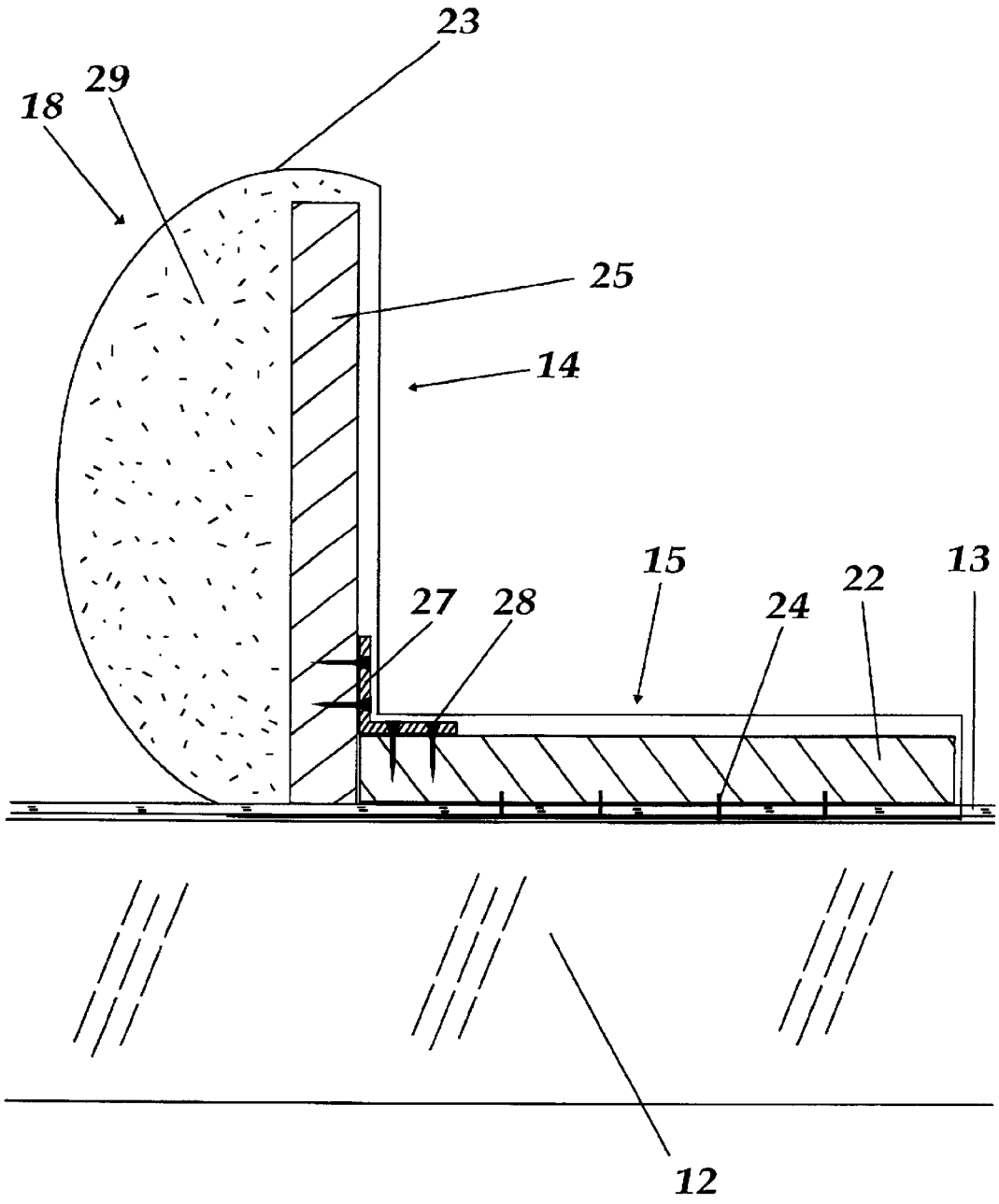
FIG. 3 is a side view of the headrest, attached to a seat back, depicting internal components.
Figure 4:
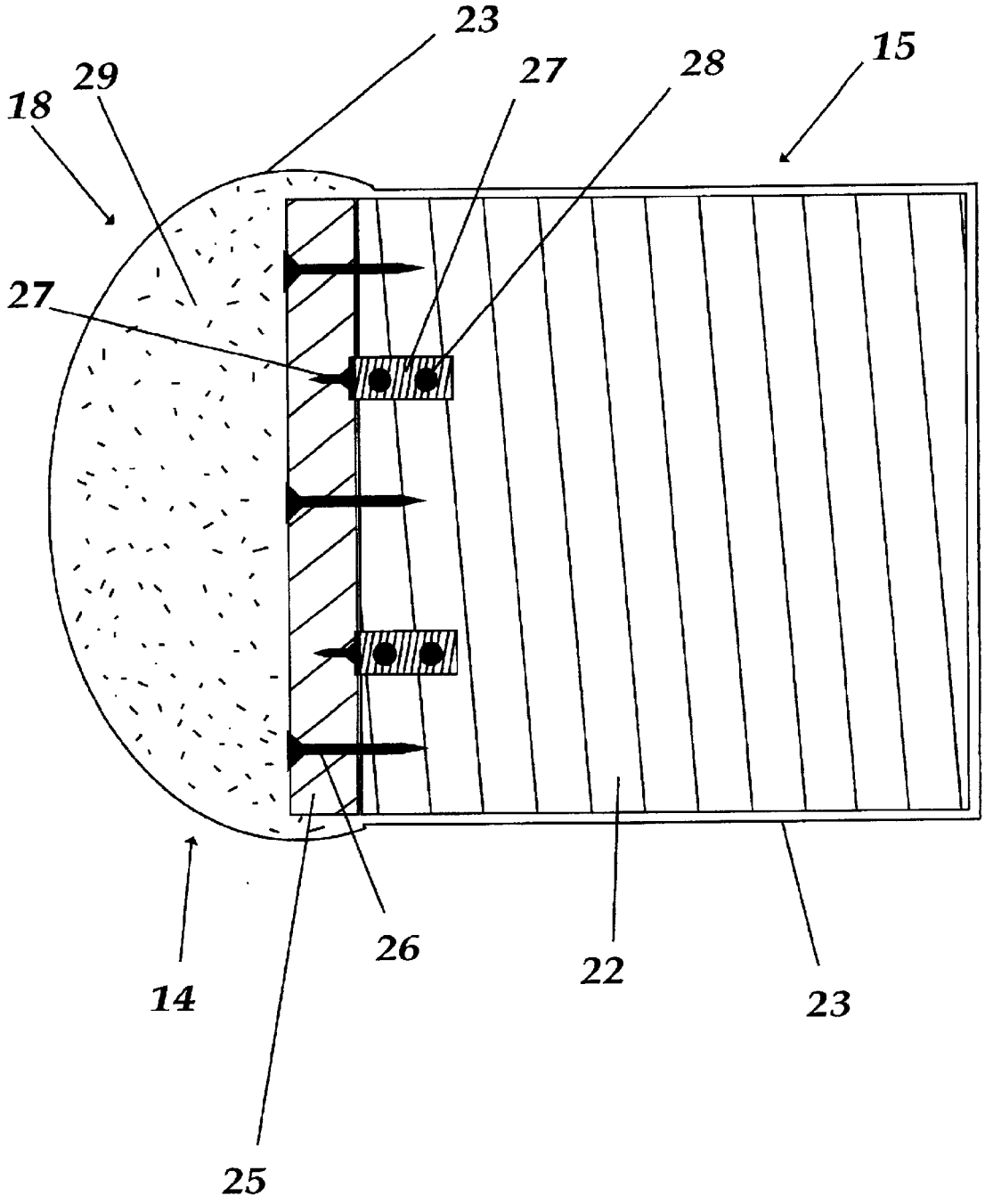
FIG. 4 is a top view of the headrest, looking toward where the seat back would be, depicting internal components.

FIGS. 3 and 4 illustrate the preferred internal structure of the headrest. FIG. 3 shows a side view, indicating the angle between the base portion 15 and the head-support portion 14. FIG. 4 shows a top view, looking at the headrest such that the seat back, if indicated, would be in the background. The base portion is preferably comprised of a wood board 22 covered in a soft, durable fabric 23. Straps 13 and 13A (only 13 is shown) are attached to the base board 22 with staples 24. The base board is joined along its edge with a head-support board 25 at a substantially right angle. Screws 26 attach the head-support board to the base board, and steel hardware L-braces 27, with fastening screws 28, provide further structural soundness and attaching means for the head-support board and base board. The cushion side 18 of the head-support portion that is opposite the base portion comprises a pillow containing cushioning material 29. Said cushioning material, which may be simple polyester fiber fill, communicating with the fabric cover 23, provides a convex pillow shape, resulting in a yielding but resilient cushioning, backed by the sturdy support of head-support board 25.

Operation of Preferred Embodiment

To use the headrest, a user merely loosens the straps 13 and 13A and then places them over the top of the seat back, lowers the headrest to the desired position, and then tightens the straps by pulling on the excess strap length 17 and 17A until the straps embrace the seat back very tightly. If the straps are not threaded through the buckles 16 and 16A, this must be done first. However, once threaded, it is only necessary to loosen and tighten the straps to store the headrest or transport it to a different chair. If the excess strap lengths are long and bothersome, they may be tucked between the surface of the seat back and the snug portions of the straps.

The force of the user's head is not required to retain the headrest in its position, nor will the force of the user's head cause the headrest to shift positions. The tightness of the straps hold the headrest in place vertically on the seat back and keep it from sliding horizontally under the weight of the user's head. The L-braces 27 prevent the head-support portion 14 from bending back upon the base portion 15: The angle of the L-braces is maintained, and the resistance of the seat back 12 to the rotating force of the headrest is communicated to the head-support portion, providing firm support to the user's head.

The headrest may be freely positioned anywhere on the seat back surface, vertically or horizontally, as long as the base portion is in substantial contact with the seat back. Thus, not only are users of different heights and seat backs of different heights accommodated, but if a user wants to change the orientation of his or her body and go back to sleep, it is a simple matter to loosen the straps and reposition the headrest.

Even during sleep, the headrest will accommodate various changes in positions because of the convex shape of the cushion side 18, whose deformable and resilient nature allows many slight variations on how a user's head will come into contact with the headrest. The headrest may, for instance, be positioned slightly higher than the head, or as is more likely to be preferred, slightly lower than the head. Furthermore, the relative positions of the headrest and user may provide for a slight bending in the neck of the user. This slight bending, combined with a slight reclining of the seat back, if available, will allow the user's head to rest somewhat declined from a perfectly upright stance, while keeping it generally and comfortably in alignment with the user's spine. In short, the user may "nestle" in the cushioning surface. The convex shape and yielding resiliency of the pillow portion, combined with its extension from the seat back in a length on a par with the diameter of the head, also prevents the user's head from rolling forward and off the headrest during relaxation.

Description of Alternative Embodiment: Hinged Joint

Figure 5:
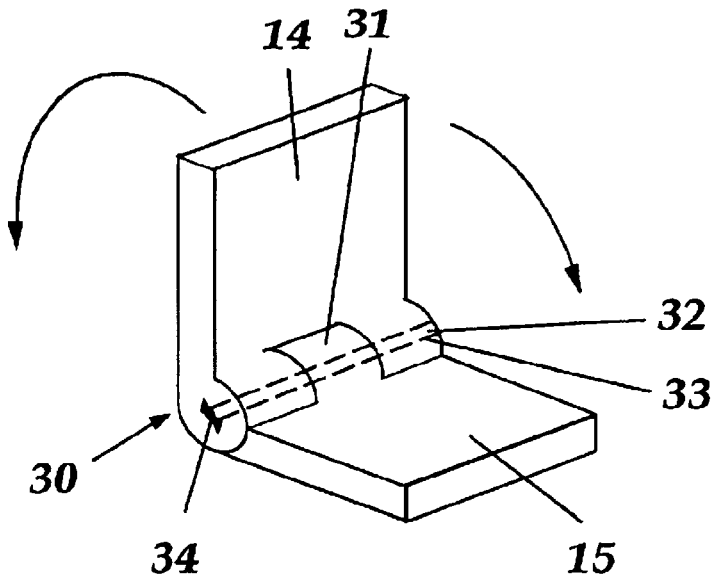
FIG. 5 is a perspective view of an alternative embodiment of the headrest employing a hinged joint.
Figure 5A:
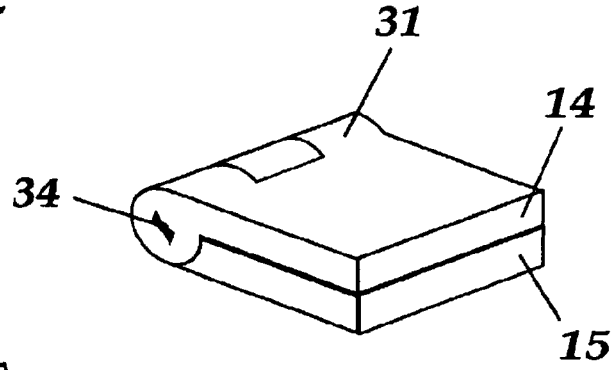
FIG. 5A is a perspective view similar to, and showing the same alternative embodiment as FIG. 5, except that the headrest is folded into a more compact form for transporting or storage.
Figure 5B:
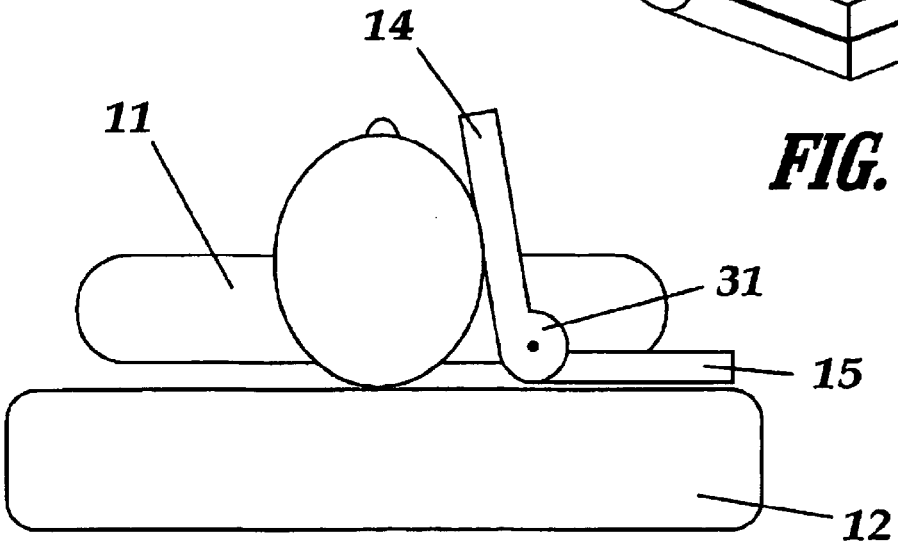
FIG. 5B is a view from above the head of a person using the alternative embodiment of the headrest referenced in FIG. 5, showing an obtuse angle between the base portion and the head-support portion.

FIGS. 5, 5A, and 5B disclose a hinged or folding variant, wherein the head-support portion 14 is engaged with the base portion 15 by means of a hinged joint 30. The hinge joint may be integrated into the form of the head-support portion and base portion themselves, as indicated in FIG. 5, such that the head-support portion and base portion form flanges of the hinge, engaged to one another with interlocking cylindrical elements 31. A tube through the rotational axis 32 can accommodate an axial pin, preferably a threaded bolt 33 secured at one end with a wingnut 34 to compress the cylindrical elements together, or other means for locking the joint at a chosen angle. Cooperating beveled gears collaring the bolt and hollow tube and attached to facing surfaces of the cylindrical elements, would allow more secure locking with less torque exerted on the wingnut. The convex cushion structure of head-support portion 14, which is labeled 21 in FIGS. 1 through 4, has been omitted from these drawings, but may be present on this alternative embodiment if desired.

FIG. 5A shows the hinged joint embodiment in a closed or folded-up position, wherein head-support portion 14 is folded back upon base portion 15.

Operation of Alternative Embodiment: Hinged Joint

While used generally in the same way as the preferred embodiment, the hinged-joint variant has additional features. To place the headrest on a seat back for use, the user should unlock the hinge joint, preferably by loosening the wingnut 34, and then positing the head-support portion 14 in a chosen angle to the base portion 15, and locking that angle by tightening the wingnut. FIG. 5B is a view of the headrest, user, and seat back from above the user's head. This view discloses the headrest locked in a position where the head-support portion 14 is at an obtuse angle to base portion 15, thus creating a space for the user's head that is defined by an acute angle between the head-support portion and the surface of the seat back 12. This angle aids the user in nestling into a comfortable position. Used in this manner, the headrest provides support for the head not just from the side, but slightly to the front; thus, the better to prevent head drooping and rolling, especially if the convex cushion-structure 21 depicted in FIGS. 1 through 4 is omitted.

For storage or easy carrying, the wingnut is loosened, or other locking means disengaged, and the head-support portion and the base portion are folded upon one another and the joint is re-locked.

Description of Alternative Embodiment: Pivoting Engagement

Figure 6:
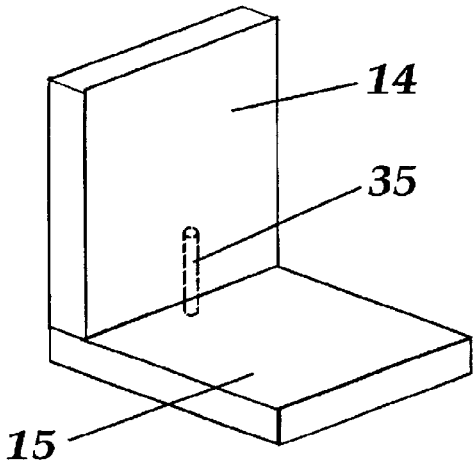
FIG. 6 is a perspective view of an alternative embodiment of the headrest employing a pivoting engagement allowing rotation of the head-support portion relative to the base portion.
Figure 6A:
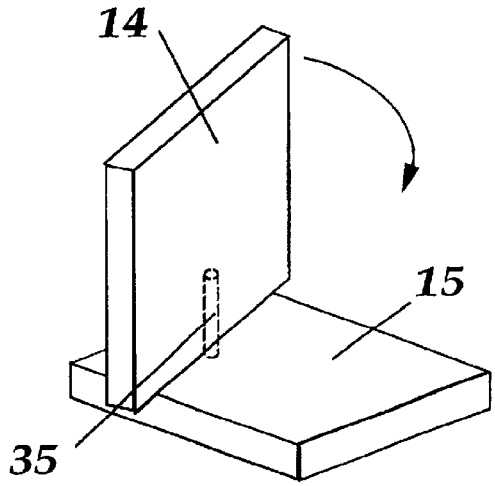
FIG. 6A is a perspective view similar to, and showing the same alternative embodiment as FIG. 6, except that the head-support portion is pivoted into a different position.
Figure 6B:
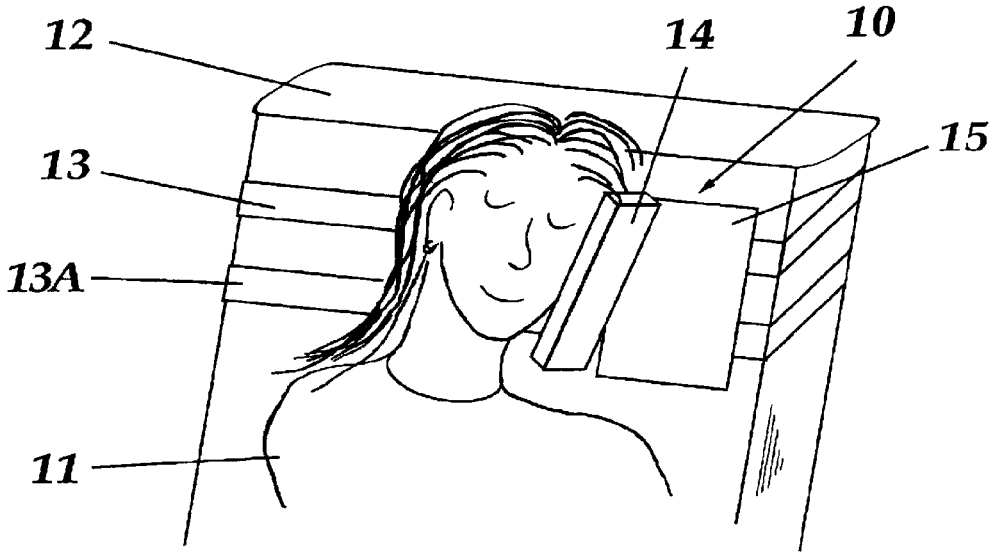
FIG. 6B is a perspective view of a person using the alternative embodiment of the headrest referenced in FIG. 6, indicating an angle in which the upward edge of the head-support portion is slightly reclined away from the user's head.

FIGS. 6, 6A, and 6B disclose a pivoting engagement variant, wherein the head-support portion 14 is engaged with the base portion 15 by means of a pivot 35. The pivot preferably includes a locking means, such as a bolt that tightens so as to compress the edge of the head-support portion that contacts the surface of the base portion, perhaps with the aid of complimentary beveled gears collaring the pivot, one mounted on the head-support portion and one mounted on the base portion. A cooperating wingnut may inhabit a recess in the seat-back facing side of the base portion.

As with FIGS. 5, 5A, and 5B, the convex cushion structure of the head-support portion 14, which is labeled 21 in FIGS. 1 through 4, has been omitted from FIGS. 6, 6A, and 6B. The convex cushion structure may be present on the pivoting-engagement embodiment if desired.

Operation of Alternative Embodiment: Pivoting Engagement

The pivoting-engagement variant is used generally in the same way as other embodiments. Additionally, however, the user may swivel the head-support portion to a desired angle. The locking means are then used to create a rigid engagement. The angle does not have to be locked however, and may freely pivot during use if desired, and still provide lateral support while maintaining a variable angle for meeting the face, head, and neck.

The pivoting adjustment can accommodate more or less bending of the neck and aids nestling into a comfortable position for sleep. If the pivot is locked and the position of the headrest on the seat back is flipped, so that, for example, it is supporting the right side head rather than the left side, then in order to procure the same angle, which has now been turned upside-down, the user only needs to unlock the pivot and swivel the head-support portion to an angle complimentary of the previous angle.

Description of Alternative Embodiment: Inflatable Structure

Figure 7:
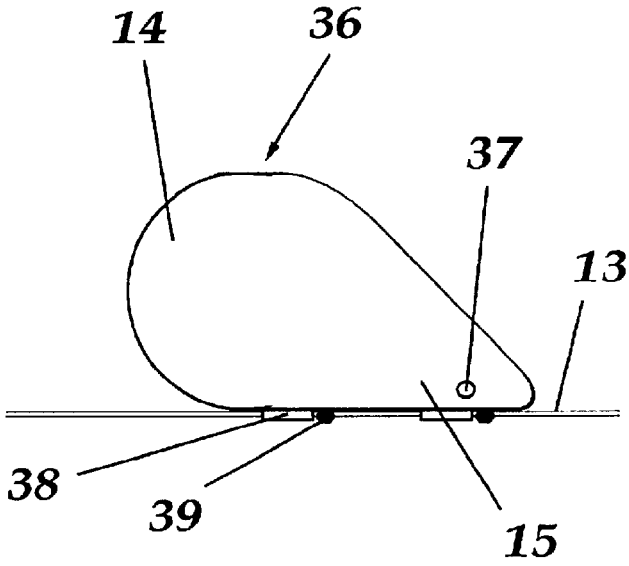
FIG. 7 is a side view of an alternative embodiment of the headrest with an inflatable structure.
Figure 7A:
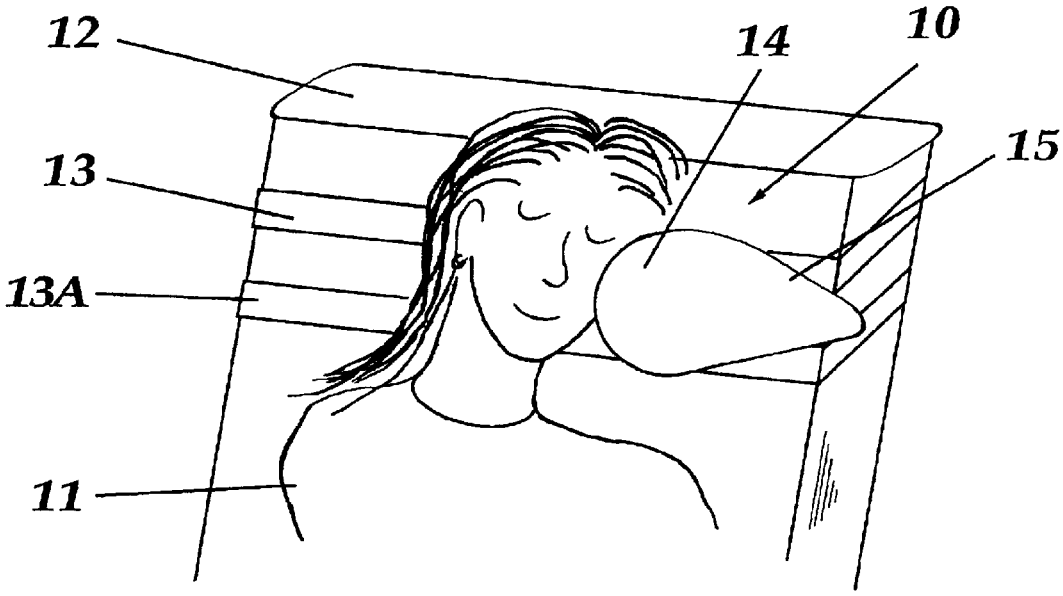
FIG. 7A is a perspective view of a person using the alternative embodiment of the headrest referenced in FIG. 7.

FIGS. 7 and 7A disclose an inflatable embodiment. The inflatable structure 36 is made from vinyl, rubber, or another suitable airtight elastic material, and is a tear-drop shape, or other suitable form. The head-support portion 14 and base portion 15 are included with the unified inflatable unit. The head-support portion includes a convex cushioning portion 21. For instance, in the tear-drop shaped embodiment depicted in FIGS. 7 and 7A, the hemispherical or dome-shaped portion of the tear drop comprises the head-support portion 14, presenting a convex cushioning portion 21; the conical, rearward portion of the tear drop comprises the base portion 15, resting against the seat back 12. It may be observed that, as with other non-inflatable embodiments, the base portion 15 prevents the head-support portion 14 from collapsing toward the seat back 12 under the weight the user's head. An air inlet valve 37 is located out the area in which a user's head, face, or neck would contact. Strap loops 38 on the inflatable unit surround the straps 13 and 13A (only one of which, 13, is shown in FIG. 7). Slide-back stoppers 39, preferably made of hard plastic, are attached to the straps and have flanges that extend beyond the opening enclosed by the strap loops.

Operation of Alternative Embodiment: Inflatable Structure

A user inflates the headrest by exhaling into the air inlet valve 18, or using a mechanical pump. Once inflated, the headrest is attached to the seat back 12 as in the above-described embodiments. Slide-back stoppers 38 prevent the headrest from sliding along the straps when the weight of the head of the user 11 is bearing upon it. After use, the headrest may be quickly deflated by opening the air inlet valve 37 and squeezing out the air thereby transforming the headrest into a deflated, compact form for storage or transport.

CONCLUSION, RAMIFICATIONS, AND SCOPE OF INVENTION

Thus the reader will see that the headrest herein described provides a comfortable and reliable means of lateral support for a person in an upright chair, such support being especially helpful to sleepy travelers in airline, rail or bus seats, and to infirmed persons with an abnormal leaning while sitting upright in a geriatric chair, or who desire or are prone to taking frequent naps while in a high-backed chair.

Although the invention has been described herein with reference to certain specific embodiments, these specificities should not be construed as limiting, but rather as exemplifications of the invention. Many variations and modifications therein will readily occur to those skilled in the art; all such modifications and variations are included within the intended scope of this invention.

One such modification would be to make the internal structure out of steel, aluminum, plastic, other metals, etc. The structural elements can be made lighter and more cheaply with the introduction of one or more struts or braces supporting the angle between the head-support portion and the base portion. The fabric cover may be omitted, or made to cover only a portion of the headrest, or it may be substituted for another covering, such as vinyl. For instance, one might manufacture the invention for hospital settings with an internal steel structure for strength and durability, a plastic housing for aesthetic value, easy cleaning, and warmth to the touch, and a vinyl-covered cushion which can be wiped down with alcohol for sterilization. Alternatively, a fitted, launderable cover with a zipper or button closure would aid hygienic usage of the headrest while maintaining maximum comfort.

Other modifications include gaining greater adjustability on multiple axes such as by a version of the headrest that employs both a pivoting engagement and hinged joint. A ball-and-socket joint may achieve the same result.

With regard to the straps and buckles that secure the headrest, a variety of attachment means may be used, including a traditional notched belt, a braided belt, rope, or even highly elastic bungee cord. In using the straps as described herein, the use of quick-release buckles of the kind referenced in U.S. Pat. No. 6,226,844 issued to Lerra, which disengage without requiring adjustment in the length of the straps thereby engaged, would add increased convenience.

Other alternative constructions would employ different shapes. For instance, the tear-drop shape of the inflatable structure could also be spherical, cylindrical, cubic, etc.

Many other variations in shape and materials may be made as well. Thus, the scope of this invention should be determined by the claims and their legal equivalents rather than by the examples provided.

SEQUENCE LISTING

Not applicable.

I claim:

1. A portable headrest adapted for detachably engaging a chair with a seat back having front and rear surfaces, comprising:

a. an inflatable structure forming, when inflated, a base portion to rest against said front surface of said seat back, said base portion having means for wrapping around said rear surface of said seat back thereby releasably and securely holding said base portion against said seat back, and b. a head-support portion that is adapted for extending far enough outward from said seat back such that said head-support portion will resist lateral bending of a user's neck and lateral rotation of said user's head, said head-support portion comprising a head-support surface being opposite said base portion such that said user's head may rest laterally against said head-support surface and dorsally against said front surface of said seat back.

2. A headrest according to claim 1 wherein:

said inflatable structure comprises a substantially tear-drop shape.

3. A headrest according to claim 1 wherein:

said means for wrapping comprises a strap loop surrounding a strap and a slide-back stopper attached thereto, having such a shape as to prevent movement of said strap loop along said strap beyond said slide-back stopper, arranged such that the weight of said user's head will exert a force such that said strap loop will engage said slide-back stopper, whereby said headrest will not move further along said strap in the direction away from said user's head

4. A portable headrest adapted for a chair having a seat back with front and rear surfaces, comprising:

a. a base portion to rest against said front surface of said seat back, said base portion having means for wrapping around said front and rear surfaces of said seat back thereby releasably and securely holding said base portion against said seat back, and b. a head-support portion, having a surface opposite from said base portion, that (1) is connected to said base portion, adapted for extending far enough outward from said seat back such that said head-support portion will resist lateral bending of a user's neck and lateral rotation of said user's head, and (2) receives said user's head on said surface opposite from said base portion such that the back of said user's head rests not against said base portion, but, when used in combination with said seat back, rests substantially against the plane of said front surface of said seat back.

5. A headrest according to claim 4 wherein:

said head-support portion additionally comprises a convex cushioning portion, on said surface opposite from said base portion, containing a deformable and resilient filler material, whereby said convex cushioning portion accommodates a variety of angles and positions relative to said user's face, head, and neck.

6. A headrest according to claim 4, in which:

said means for wrapping comprises two straps, each of said straps having two ends, said two ends of each of said straps being attachable together with a length-adjustable buckle.

7. A headrest according to claim 4 wherein:

said head-support portion is engaged with said base portion with a hinged joint, said hinged joint being releasably locked at a chosen angle defined by the plane of said seat back and the plane of said head-support portion whereby said user may collapse said headrest into a smaller size for convenience in portability, and whereby said user may chose various such angles for positioning said head-support portion against said user's face, head, and neck.

8. A headrest according to claim 4 wherein:

said head-support portion is engaged with said base portion with a pivoting means such that said head-support portion may pivot to various angles perpendicular to the plane of said seat back whereby said user may chose various such angles for positioning said head-support portion against said user's face, head, and neck.

9. A headrest according to claim 4 wherein:

said head-support portion is engaged with said base portion at a substantially right angle.

* * * * *